US005390881A

United States Patent [19]

Benenowski et al.

[11] Patent Number: 5,390,881

[45] Date of Patent: Feb. 21, 1995

[54] ROLLER ASSEMBLY FOR A SWITCH TONGUE USED WITH A STOCK RAIL

[75] Inventors: Sebastian Benenowski, Butzbach; Erich Nuding, Aalen; Hans-Ulrich Dietze, Wusterwitz, all of Germany

[73] Assignee: BWG Butzbacher Weichenbau GmbH, Butzbach, Germany

[21] Appl. No.: 89,575

[22] Filed: Jul. 12, 1993

[30] Foreign Application Priority Data

Jul. 22, 1992 [EP] European Pat. Off. ..... 92112528

[51] Int. Cl.[6] ..... E01B 7/00

[52] U.S. Cl. ..... 246/453

[58] Field of Search ..... 246/415 R, 430, 435 R, 246/435 A, 447, 453; 267/47

[56] References Cited

U.S. PATENT DOCUMENTS

| | | | |
|---|---|---|---|
| 1,965,803 | 7/1934 | Post et al. | 246/453 |
| 2,471,357 | 5/1949 | Smith | 246/453 X |
| 2,533,929 | 12/1950 | Gray et al. | 246/453 X |
| 4,105,175 | 8/1978 | De Spiegeleer | 246/453 X |
| 4,747,898 | 5/1988 | Woltron | 246/47 X |

FOREIGN PATENT DOCUMENTS

| | | | |
|---|---|---|---|
| 389851 | 10/1990 | European Pat. Off. | 246/453 |
| 314265 | 9/1919 | Germany . | |
| 361444 | 4/1921 | Germany | 246/453 |
| 1056641 | 2/1957 | Germany . | |
| 1658366 | 10/1967 | Germany . | |

*Primary Examiner*—Robert J. Oberleitner
*Assistant Examiner*—S. Joseph Morano
*Attorney, Agent, or Firm*—Dennison, Meserole, Pollack & Scheiner

[57] ABSTRACT

A roller assembly for a rail switch tongue used with a stock rail exhibiting reduced friction and resistance to vibration includes roller elements for supporting the switch tongue. Each roller element is supported by elastomer springs, one having a damping and the other having a supporting characteristic. The spring elements are mechanically coupled so that loading of the roller elements by the switch tongue causes a change in the spring length.

7 Claims, 2 Drawing Sheets

ROLLER ASSEMBLY FOR A SWITCH TONGUE USED WITH A STOCK RAIL

BACKGROUND OF THE INVENTION

The invention refers to a roller assembly for a switch tongue used with a stock rail and extending directly or indirectly from a support such as a railroad tie.

In order to reduce friction when throwing switch tongues, the switch tongues can be placed on rollers. It is customary, for instance, to place rollers in a roller block which has a fixed distance from a stock rail (DE-A 16 58 366).

A spring supported roller bearing for switch tongues that is adjustable at its height is known from DE-B 1 056 641. The roller bearing used in that case has a purely support function. The roller itself is in a roller block which is set in a cage of a bearing block. Since the spring does not damp, it is possible to get knocking between the roller block and the bearing block. This in turn leads to intermittent shock load on the tongue.

In U.S. Pat. No. 1,965,803, a switch tongue is described which is supported by a spring packet. In order to make adjustment of the tongue easier, a roller extends from this spring packet.

SUMMARY OF THE INVENTION

The problem that forms the basis of this invention is to make sure that the switch tongue does not hit on a support such as a slide bed if vibrations take place.

This problem is essentially resolved according to the invention by having the roller element supported on at least two spring elements of differing characteristics so that one spring element displays an essentially constant rigidity and the other spring element a variable rigidity and so that these spring elements are mechanically connected to one another in such a way that for roller elements loaded by the tongue each spring element exhibits a corresponding change in length.

The invention is characterized in particular by the fact that the spring elements extend to opposed sides of a support element and can be aligned to one another at variable distances by means of a connecting element such as a bolt and nut, so that the damping-generating spring element with variable rigidity runs on the support element side turned away from the tongue, so that in the case of unloaded roller elements like these, the spring element with the variable rigidity is pulled against the support element by the connecting element thus eliminating or essentially eliminating any spring action, and so that in the case of a loaded roller element each of the spring elements displays a change in spring length in response to the customary additional loading and unloading of the roller element.

In the case of the spring elements, we are dealing on the one hand with a support spring and on the other with a damping spring, where it is recommended that both springs, or at least, however, the latter, be elastomer springs. In this case the damping spring displays a rigidity which preferably is ten times less than that of the support spring.

In the case of the spring elements being prestressed, that is, when the roller element is not loaded, the damping spring is set on or almost on the block in order thus to cause the roller element loaded by the tongue to move into an operational position (operating point), whereas it is impossible in the case of conventional loading and unloading (tongue loading) of the roller element to reach the initial stress point of the block.

Through the damping spring, a spring action takes place in the operating point and with this a damping in both directions, so that it is not possible for the tongue to bang on a support such as a slide bed. At the same time, because of the damping characteristics of the damping springs, a rapid reduction of vibrations in the tongue itself is accomplished.

Through the rigidity of the support springs, the operating position of the roller elements, i.e., that level at which the tongue comes to rest, is determined in advance.

In accordance with a further object of the invention to be emphasized, the roller element can extend from a receiver in which the tongue is fixable in a position some distance away, for example, in a form-locking position. In this case the receiver itself can be connected in the usual way with the stock rail, but preferably with a support such as a railroad tie. The latter measure produces a further uncoupling to the stock rail.

By fixing the tongue in a position some distance away, it is ensured that vibrations introduced are not able to lead to an undesired banging of the switch tongue and thus to an undesired failure.

Further details, advantages and characteristics of the invention can be seen from the claims themselves and from the design examples shown in the drawings.

DETAILED DESCRIPTION OF A PREFERRED EMBODIMENT

Figure 1A:
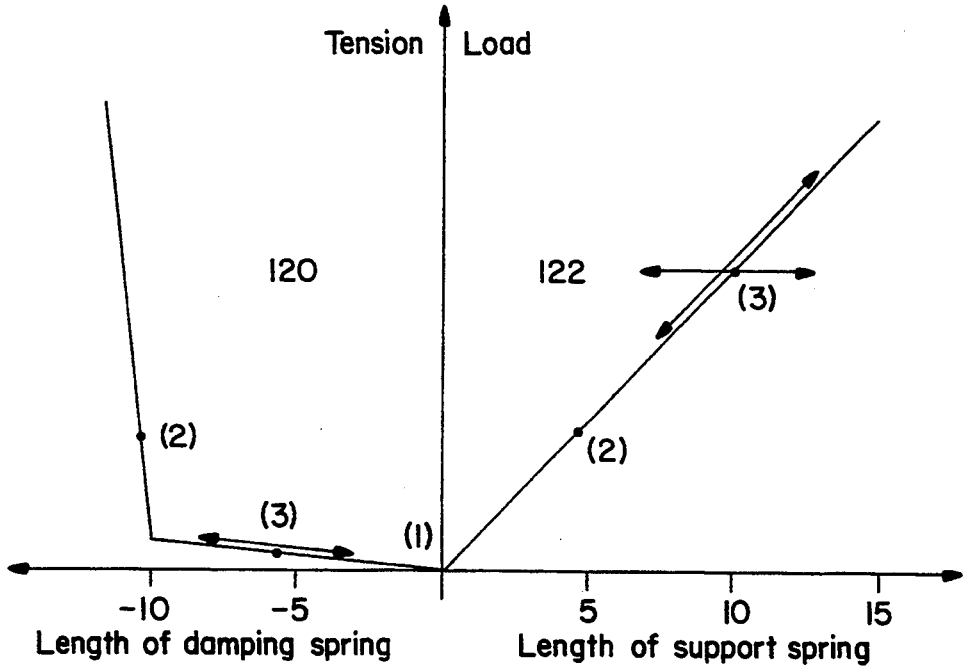
FIGS. 1A–D A diagram of spring characteristics of roller element-supporting spring elements with their corresponding positions and FIG. 2 A diagrammatic representation of roller elements extending from a railroad tie and supportable on spring elements.
Figure 1B:
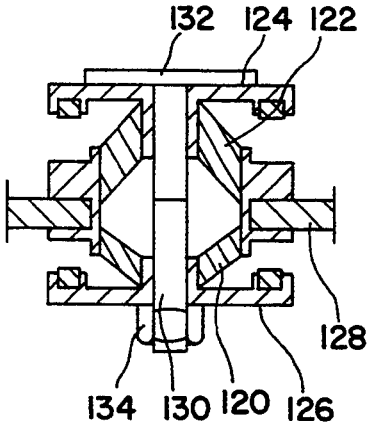
Figure 1C:
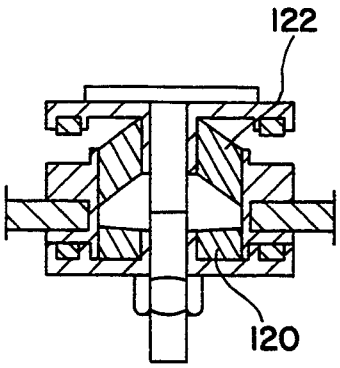
Figure 1D:
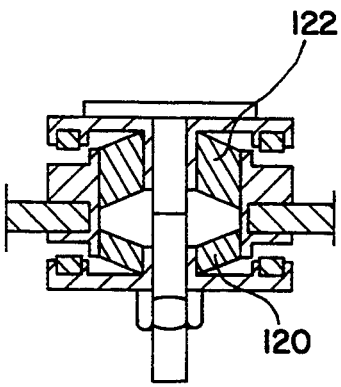
Figure 2:
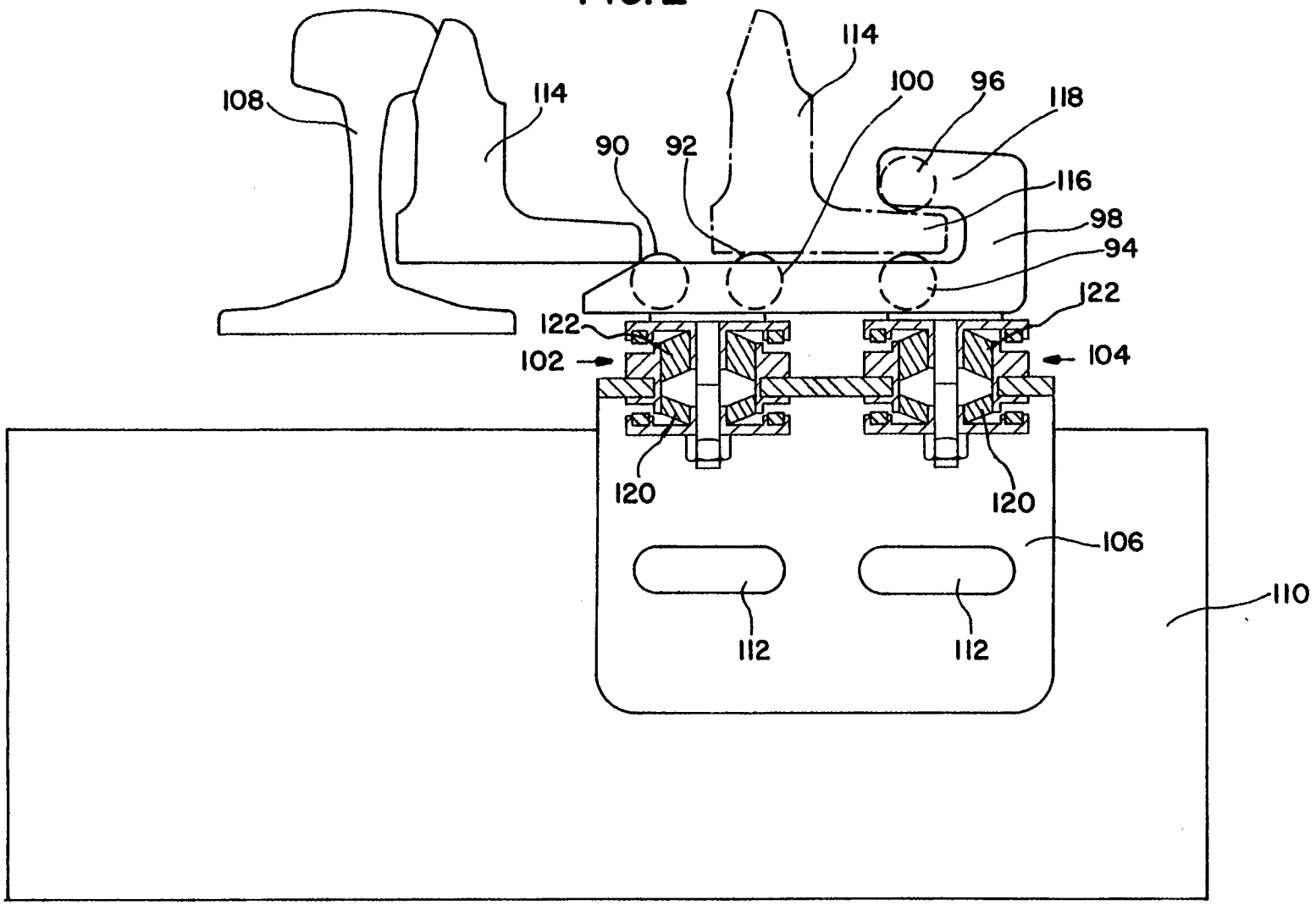

The characteristics derived from the theory used according to the invention are shown in FIGS. 1 and 2. These characteristics make it possible for a switch tongue placed on roller elements or a switch tongue that is to be thrown to be damped in a range so that there is no banging on supports such as slide beds. At the same time, it is guaranteed that there will be no destructive shock-like banging on the roller elements themselves, a disadvantage which is inherent in the state of technology found in roller elements today.

In FIG. 2, roller elements (90, 92 and 94), as well as a further roller element (96), extend from a receiver (98) which in a side view looks like a U lying on its side and which has different side lengths. In this case, the longer side (100) faces a mounting support (106). The receiver (98) is supported by spring mechanisms (102 and 104), which on their part are fastened onto the mounting support (106), which in the design example shown extends from a railroad tie (110). In this case, the mounting support (106) can be moved towards or from a stock rail (108). Moreover, the side legs of the mounting support (106) have slotted holes elongated openings (112) which can be used to connect mounting supports (106) to the railroad tie (110) with connecting fastening elements such as screws.

The receiver (98) itself preferably consists of two side pieces formed as a U, in which the roller elements (90, 92, 94 and 96) are located and which side pieces are connected on top, for example, with a flat plate which is fastened to the spring mechanisms (102 and 104).

FIG. 2 shows in side view the arrangement of the supporting structure for a switch tongue (114), a stock rail (108), on the one hand in an abutting position (solid line) and on the other hand in the spaced-away position (broken line). In the spaced-away position, a portion of the foot of the switch tongue (116) comes to rest between the rollers (94 and 96), that is between the short side (118) and the long side (100) of an U-shaped receiver (98). The U-shaped receiver supports the roller elements (90, 92, 94 and 96). The arrangement of roller elements (94, 96) makes it possible to quasi-lock the switch tongue (114) in the spaced-away position so as to prevent banging.

The essential components of spring mechanisms (102 and 104) are spring elements (120 and 122) wherein each element is of a different rigidity, whereby vibrations introduced into the switch tongue (114) are damped. At the same time a quasi-static support for the switch tongue (114) is provided.

FIGS. 1B,C,D show one of the preferably identically constructed spring mechanisms (102 and 104) and the characteristics of the individual spring elements are shown in FIG. 1A. Each spring mechanism (102 or 104) consists of an upper and a lower plate element (124 and 126), preferably made of metal, and a support beam plate (128) which runs between these plate elements and extends from the mounting support (106). The spring elements (122 or 120) of different rigidities extend between the support beam plate (128) and the upper plate (124) on the one side and between the support beam plate (128) and the lower plate (126) located at a distance away from the stock rail (108).

The spring elements (120 and 122) are both elastomer springs which are joined or vulcanized with the plates (124, 126 and 128), or joined with sections extending from the plates. The rigidities of these spring elements, i.e., the relationship between Tension/Load and spring length (Extension/Compression) are shown in FIG. 1A.

The spring elements (120 and 122) are mechanically joined by a connecting element (130) such as bolt (130) and nut (134). This connecting element crosses the spring mechanisms (102 or 104) centrally. In the design example we are dealing with a bolt (130) with a plate-shaped head (132) which rests against the outer side of the plate (124) and whose nut (134) rests against the outer side of the plate (126), so that by tightening the nut (134) we can adjust the effective length of the connecting element (130) between the plates (124 and 126).

In the case of the spring element (120), we are dealing with a damping spring with varying rigidity. The spring element (120) should preferably show a progressive characteristic curve, which the left part of FIG. 1A should illustrate.

The upper spring element (122) close to the stock rail (108) shows a spring characteristic curve with constant or essentially constant rigidity and should exercise the actual support function.

In the uncompressed state, the spring mechanisms (102 and 104) show a position which corresponds to FIG. 1B. The plates (124 and 126), from which extend on the one side the support spring (122) and on the other side the damping spring (120), are placed at a distance from the support beam plate (128). In FIG. 1A, this state coincides with the origin of coordinates of the diagram, in which the force (tension/load) applied against the spring is related to the length of the spring.

FIG. 1C shows how to bring the spring mechanisms (102 and 104) into operating position which allows the receiver (98) to be lifted above its normal position. The switch tongue (114) is set on the roller elements (90, 92 and 94)—into a position in which the receiver (98) is set for loading. The nut (134) is then tightened until the spring element (120) lies on or almost on the block, that is, pushed together and compressed so that spring characteristics no longer exist. This state corresponds to initial stress point 2 in FIG. 1A.

FIG. 1D is a purely schematic representation of the position in which the switch tongue (114) is supported on the roller elements (90, 92 and 94). The damping spring (120) is unloaded and extended to its full length (FIG. 1A indicating five length units purely as an example). At the same time, the support spring (122) is loaded to the same spring length, thus shown in the drawing by five length units. This position corresponds to point 3 in FIG. 1A, which is the operating point.

If vibrations are now introduced into the switch tongue (114), these vibrations can then be completely absorbed by the spring mechanisms (102 and 104) and can be damped in particular by the spring element (120) without banging taking place, since the operating point 3 is set in relation to the spring characteristics in such a way that the damping spring (120) does not reach the block position where spring characteristics cease to exist. By this precompression of the spring elements it is possible to achieve the spring active state of the spring mechanisms (102 and 104) when the switch tongue (114) is subjected to a loading or unloading.

We claim:

1. A roller assembly and receiver for a switch tongue used with a stock rail and extending from a supporting railroad tie, comprising a substantially U-shaped receiver and roller elements to movably support the switch tongue on said roller elements, said U-shaped receiver in turn supported on at least one spring mechanism, wherein the spring mechanism includes first and second spring elements having different characteristics, the first spring element having a substantially constant rigidity and the second spring element having a varying rigidity, the first and second spring element being mechanically coupled with one another by connecting means so that when the roller elements are loaded by the switch tongue, each spring element operates in a spring-active state and changes in length in response to loading and unloading whereby vibrations are damped.

2. The roller assembly according to claim 1 wherein the spring mechanism includes a support element and the spring elements extend on opposed sides of said support element, are aligned to one another at variable distances by said connecting means, the second spring element with the varying rigidity performs a damping function and runs along the side of the support element facing away from the switch tongue, so that when the roller element is not loaded, the spring element with varying rigidity is pulled by the constant rigidity spring element and the connecting means against the support element, whereby the spring active state is substantially eliminated.

3. The roller assembly according to claim 1, wherein the roller element are moved away from the receiver when in the abutting position and in which the switch tongue is fixed when in the spaced-away position the receiver extends from a supporting railroad tie.

4. The roller assembly according to claim 1, wherein each spring element is made of an elastomer material.

5. The roller assembly according to claim 1, wherein the connecting means is in the form of a bolt and a nut.

6. A roller assembly support for a switch tongue used in conjunction with a stock rail and extending from a supporting railroad tie, comprising: roller elements for supporting the switch tongue, said roller elements being supported by a U-shaped receiver and said receiver being in turn supported by at least one spring mechanism, said spring mechanism having a first and second spring element the characteristics of the first and second spring elements being different so that the first spring element has an essentially constant rigidity and the second spring element has a varying rigidity, the spring elements are mechanically coupled with one another by connecting means so that when the roller elements are loaded by the switch tongue each spring element operates as an active spring.

7. A roller assembly support for a switch tongue used in conjunction with a stock rail and extending from a supporting railroad tie, comprising: roller elements for supporting the switch tongue, said roller elements being supported by a U-shaped receiver and said receiver being in turn supported by at least one spring mechanism, said spring mechanism having a first and a second spring element the characteristics of the first and second spring elements being different so that the first spring element has an essentially constant rigidity and the second spring element has a varying rigidity, the spring elements are mechanically coupled with one another by connecting means so that when the roller elements are loaded by the switch tongue each spring element operates as an active spring, wherein the spring mechanism includes an upper and a lower plate element and a support beam plate, the spring elements extend on opposite sides of the support beam plate, the first spring element with constant rigidity between the support beam plate and upper plate element facing toward the switch tongue, the second spring element with varying rigidity between the support beam plate and lower plate element facing away from the switch tongue, said connecting means operating to align the spring elements to one another and to fix the distance between said upper and lower plate elements so that when the roller elements and U-shaped receiver are loaded by the switch tongue the second spring element is extended and performs a damping function and when not loaded by the switch tongue said second spring element is compressed so that it is inactive as a spring.

* * * * *